United States Patent [19]

Fain

[11] 4,303,247

[45] Dec. 1, 1981

[54] CATAPULT GAME

[76] Inventor: David A. Fain, 1933 Lamont St., Kingsport, Tenn. 37664

[21] Appl. No.: 163,640

[22] Filed: Jun. 27, 1980

Related U.S. Application Data

[63] Continuation-in-part of Ser. No. 965,934, Dec. 4, 1978, abandoned.

[51] Int. Cl.[3] ..... A63B 65/12

[52] U.S. Cl. ..... 273/324; 273/DIG. 30

[58] Field of Search ..... 273/323, 324, 318, 343–347, 273/58 K, 416, DIG. 30; 124/41 R–41 C

[56] References Cited

U.S. PATENT DOCUMENTS

| | | | |
|---|---|---|---|
| 2,465,808 | 3/1949 | Killam | 273/324 |
| 2,835,494 | 5/1958 | Hull | 273/324 |
| 3,032,345 | 5/1962 | Lemelson | 273/346 |
| 3,342,491 | 9/1967 | Padovani | 273/324 |
| 3,618,585 | 11/1971 | Allison | 273/DIG. 30 |
| 3,857,566 | 12/1974 | Lemelson et al. | 273/DIG. 30 |
| 3,874,666 | 4/1975 | Ross | 273/73 R |
| 3,917,271 | 11/1975 | Lemelson et al. | 273/DIG. 30 |
| 3,927,881 | 12/1975 | Lemelson et al. | 273/DIG. 30 |
| 3,953,030 | 4/1976 | Muchnik | 273/26 E |
| 4,029,316 | 6/1977 | Clarke | 273/58 K |
| 4,166,618 | 9/1979 | Sheem | 273/343 |
| 4,234,183 | 11/1980 | Stephens | 273/318 |

*Primary Examiner*—Vance Y. Hum

[57] ABSTRACT

A game comprising (a) a missile in the shape of a spheroid having at least a portion of its surface defined by an outwardly presented face provided with a first type of contact engaging material;

(b) a flexible resilient, self supporting sheeting material capable of manipulation with two hands, the shape of which is substantially biaxially symmetrical one axis of which is substantially greater than the other axis;

(c) said flexible resilient, self supporting sheeting material having at least a portion of at least one of its surfaces covered with a second type of contact engaging material;

(d) one of said contact engaging materials comprising a surface of textile material defined by a multitude of irregular filamentary formations and the other of said contact engaging materials comprising a covering being composed of upstanding hook-like filamentary formations adapted for removably retentive imbediment in said surface having irregular filamentary formations;

(e) whereby when said missile is directed against the contact engaging material of said flexible resilient, self supporting sheeting material, said first and second types of contact engaging material engage with each other to removably retain said missile thereagainst in the area of impact;

(f) said flexible resilient, self supporting sheeting material being further characterized by having an overall balance of general mechanical properties such that when said missile is engaged and interlocked to the contact engaging material of the flexible resilient sheeting material thereby being rendered removably retained, said flexible resilient sheeting material can be manually flexed by compressive force applied along the longitudinal axis from a resting planar configuration to a concave configuration such that the missile is removably retained in the concavity of the flexible resilient sheeting material, and said material can then be relaxed and then manually and forcibly snapped outwardly in a direction going from the concave configuration through the planar posture and into the convex configuration with sufficient force to thereby disengage the missile from the contact engaging material of the flexible resilient sheeting material and catapult said missile in the direction of convexity.

10 Claims, 4 Drawing Figures

CATAPULT GAME

This application is a continuation-in-part of Ser. No. 965,934, filed Dec. 4, 1978, now abandoned.

This invention relates to a game and amusement apparatus and in particular to a device for catapulting or throwing, as well as catching, spherical missiles. More specifically, this invention relates to a catapulting device particularly adapted for use in safety type games employing targets constructed of pile materials defined by a multitude of fine filamentary hook-like formations across the surface thereof.

It is known in the art to provide target games formed of so-called hooking textile materials which form a part of a target and a missile. Typical configurations and arrangements are illustrated in U.S. Pat. Nos. 3,032,345, 3,857,556, and 3,927,881. These patents show the use of a fastening material known as Velcro made by the American Velcro Corporation, New York, N.Y.

Such Velcro material has been generally used for clothing closures. A typical Velcro type closure unit generally consists of two strips of flexible wool-like material one of which has a multitude of tiny monofilament hooks protruding from its surface, there being thousands to the square inch, with the other material consisting of a flexible cloth or textile band having a multitude of tiny wire-like filaments sewn thereto into a multitude of loops each of which protrudes outward from the surface thereof. These two strips could arbitrarily be referred to as a first type of contact engaging material and a second type of contact engaging material. When the surfaces of the materials are brought together the hooks become engaged in the loops in a random manner and the net effect is to provide a means for holding one material against the other which generally requires at least several ounces of force to separate the two materials. These materials are relatively simple and safe for use in playthings since the hooked component thereof has essentially the texture of rough wool and the looped component provides a surface which is free of rigid or sharp projections and is yieldable.

Accordingly, it is the object of this invention to provide a new skill and amusement game using the above materials.

Accordingly, there is provided a game comprising (a) a missile in the shape of a spheroid having at least a portion of its surface defined by an outwardly presented face provided with a first type of contact engaging material;

(b) a flexible resilient, self supporting sheeting material capable of manipulation with two hands, the shape of which is substantially biaxially symmetrical one axis of which is substantially greater than the other axis;

(c) said flexible resilient, self supporting sheeting material having at least a portion of at least one of its surfaces covered with a second type of contact engaging material;

(d) one of said contact engaging materials comprising a surface of textile material defined by a multitude of irregular filamentary formations and the other of said contact engaging materials comprising a covering being composed of upstanding hook-like filamentary formations adapted for removably retentive imbediment in said surface having irregular filamentary formations;

(e) whereby when said missile is directed against the contact engaging material of said flexible resilient self supporting sheeting material, said first and second types of contact engaging material engage with each other to removably retain said missile thereagainst in the area of impact;

(f) said flexible resilient, self supporting sheeting material being further characterized by having an overall balance of general mechanical properties such that when said missile is engaged and interlocked to the contact engaging material of the flexible resilient sheeting material thereby being rendered removably retained, said flexible resilient sheeting material can be manually flexed by compressive force applied along the longitudinal axis from a resting planar configuration to a concave configuration such that the missile is removably retained in the concavity of the flexible resilient sheeting material, and said material can then be relaxed and then manually and forcibly snapped outwardly in a direction going from the concave configuration through the planar posture and to a convex configuration with sufficient force to thereby disengage the missile from the contact engaging material of the flexible resilient sheeting material and catapult said missile in the direction of convexity.

With the above and such other objects in view as may hereafter more fully appear, the invention consists of the novel constructions, combinations and arrangements of parts as will be more fully described and illustrated in the accompanying drawings, but it is to be understood that changes, variations and modifications may be resorted to which fall within the scope of the invention, as claimed.

Figure 1:
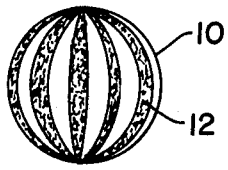
FIG. 1 illustrates an example of one possible configuration of a spherical missile forming a portion of one embodiment of the invention.

In FIG. 1 is shown a missile in the form of a ball 10 having its outer surface partially covered with one type of contact engaging material 12 permitting it to engage and be retained against the surface of the second type contact engaging material secured to the flexible resilient sheeting material described hereinafter with more particularity. In a preferred embodiment of this invention the contact engaging material on the spheroidal missile is a Velcro type material as described above. The ball 10 of FIG. 1 is preferably composed of a lightweight spherical base such as a blow molded or injection molded plastic ball or a cork ball to the surface of which has been bonded a plurality of sections of broken loop Velcro fastening material. The sections of this Velcro material may be die cut from stripped Velcro material and adhesively bonded to cover the entire surface of the ball missile or any other size missile which is desired. The balls suitable for use in practicing a game of this invention are described with greater particularity in U.S. Pat. Nos. 3,927,881, 3,857,566, 3,917,271, and 3,032,345, all incorporated herein by reference. The size and weight and amount of Velcro material covering the surface of the spherical missile is variable and dependent upon the manner in which one desires to have the game played. For example, the heavier the ball the greater the momentum the participant is able to catapult it with. For adults playing this game such a ball would be desirable. For children of different ages playing the game it may be more desirable to have a lighter weight ball.

Figure 2:
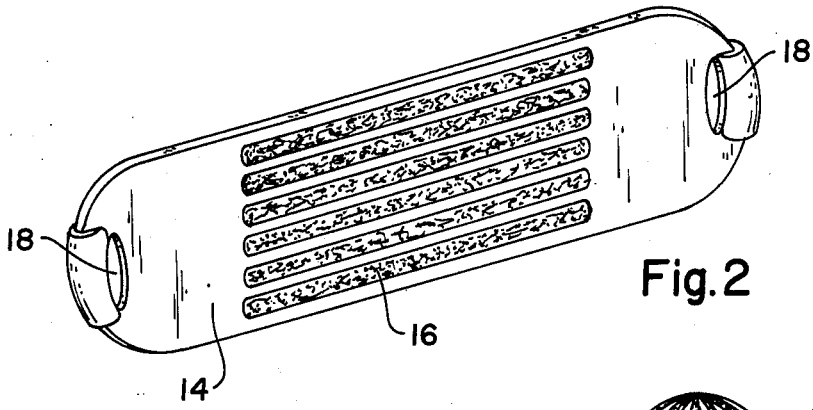
FIG. 2 is a perspective view of one possible embodiment of a flexible resilient sheeting material capable of manipulation to propel a spheroid missile.

In FIG. 2 is shown a flexible resilient, self supporting sheeting material, hereinafter sometimes referred to as FRSM, having one of its surfaces 14 covered at least in part with strips of one type of contact engaging material 16. Preferably, this contact engaging material is comprised of a surface of textile material defined by a multitude of irregular filamentary formations such as a pile type textile material. The various types of materials capable of engaging with the Velcro like contact engaging materials are well known in the art. The FRSM can be made of any flexible material provided the overall balance of general mechanical properties are such that when said missile is engaged and interlocked to the contact engaging material of the flexible resilient sheeting material thereby being rendered removably retained, said flexible resilient sheeting material can be manually flexed along the longitudinal axis from a resting planar configuration to a concave configuration such that the missile is removably retained in the concavity of the flexible resilient sheeting material and then manually and forcibly snapped forward in a direction going from the flexible resilient sheeting material through the missile into a convex configuration with sufficient force to thereby disengage the missile from the contact engaging material of the flexible resilient sheeting material and catapult said missile in the direction of convexity.

The FRSM, therefore, may be of a suitable plastic or metal material such as a polyolefin, such as polypropylene, polyester, or spring steel. If the game is to be played by adults a stiffer material such as a thin sheet of flexible steel might be appropriate. Alternatively, a thicker molded plastic would be more appropriate for adult used. If the game is to be played by children the desirable overall properties of the FRSM can be adjusted accordingly. Additionally, the length and width of the FRSM can be adjusted to conform to a desired size depending upon the age and capabilities of the players of the game.

In a preferred embodiment of this invention the FRSM will be so designed as to be capable of allowing the easiest manipulation by the participants. To this end it has been determined the FRSM should contain enlarged handles 20 disposed at each longitudinal end forming finger apertures 18. These handles are preferably so structured so as to enable the participant to impart a quick and forcible snap to the FRSM.

Figure 3:
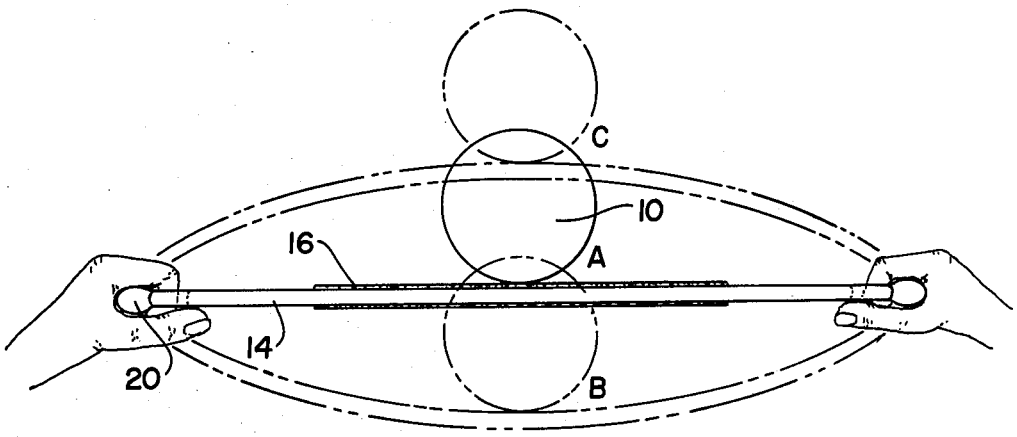
FIG. 3 is a top view of the flexible resilient sheeting material depicted in FIG. 2 illustrating the manner in which the spherical missile depicted in FIG. 1 may be catapulted in a forward direction.

FIG. 3 is a top view of the FRSM illustrating the manner in which the spherical missile depicted in FIG. 1 may be catapulted in forward direction. The missile 10 in position A when at rest is engaged with the contact engaging material 16 of the FRSM. To catapult the missile forward the FRSM is then manually flexed by compressive force along the longitudinal axis from resting planar configuration A to a concave configuration B. The FRSM is then relaxed by removal of the compressive force and then manually and forcibly snapped forward or outwardly again by compressive longitudinally applied force to impart a convex configuration C with sufficient force to thereby disengage the missile from the contact engaging material of the FRSM and catapult said missile in the direction of convexity. As can be appreciated the harder the FRSM is snapped forward by the compressive, longitudinally applied force the greater the distance the disengaged missile will travel.

Figure 4:
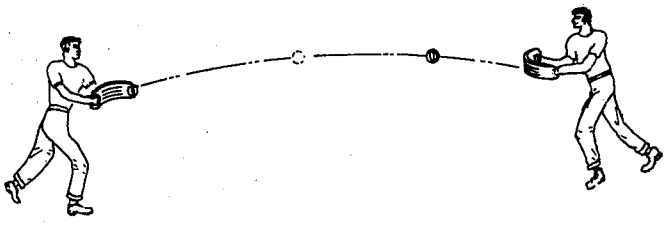
FIG. 4 is a view of two participants playing the game of this invention using the apparatus of this invention.

The game of this invention is preferably played with two players as depicted in FIG. 4. One player catapults the missile to the other player who attempts to catch the missile on the contact engaging material of his FRSM. Alternatively, one or more players could use the FRSM to direct the missile at a stationary target such as described in U.S. Pat. No. 3,857,566.

Although the invention has been described in considerable detail with particular reference to certain preferred embodiments thereof, variations and modifications can be effected within the spirit and scope of the invention.

I claim:

1. Apparatus for missile launching and catching comprising (a) a missile in the shape of a spheroid having at least a portion of its surface defined by an outwardly presented face provided with a first type of contact engaging material;

(b) a flexible, resilient, self-supporting body of sheeting material capable of manipulation with two hands, the shape of which is substantially biaxially symmetrical, the longitudinal axis of which is substantially greater than the transverse axis, said sheeting material being constructed and arranged to permit said body to be flexibly transformed from a resting planar configuration to a concave configuration under compressive force, from said concave configuration back to said planar configuration upon release of said compressive force, and, by momentum, therebeyond to a slightly convex form;

(c) handle means disposed in opposing relationship on said body for receiving and releasing compressive force manipulations from said two hands;

(d) said body having at least a portion of at least one of its surfaces covered with a second type of contact engaging material;

(e) one of said contact engaging materials comprising a surface of textile material defined by a multitude of irregular filamentary formations and the other of said contact engaging materials comprising a covering being composed of upstanding hook-like filamentary formations adapted for removably retentive imbediment in said irregular filamentary formations;

(f) whereby in a first mode, when said missile is directed against the contact engaging material of said body, said first and second types of contact engaging material engage with each other to removably retain said missile on said body in the area of impact; and, in a second mode, (g) said body having an overall balance of general mechanical properties such that when said missile is engaged and interlocked to said second type of contact engaging material, said body can be manually flexed by compressive force applied at the handle means thereof directed along the longitudinal axis, from a resting planar configuration to a concave configuration such that the missile is removably retained in the concavity of said body, and then by rapid release of said compressive force said body can flex back to its planar configuration and, by momentum, therebeyond to a slightly convex configuration whereupon rapid longitudinal compressive force can again be applied to rapidly form said body into an exaggeratedly convex configuration and thereby propel the missile from said body in the direction of convexity.

2. The game according to claim 1 wherein the missile is in the shape of a ball and the contact engaging material is composed of hook-like filamentary formations.

3. The game according to claim 2 wherein the flexible resilient sheeting material is of a plastic material.

4. The game according to claim 2 wherein the length of the flexible resilient sheeting material is at least 25 percent longer than the width.

5. The game according to claim 1 wherein the missile is in the shape of a ball and the contact engaging material is a pile textile material defined by a multitude of irregular filamentary formations.

6. The game according to claim 5 wherein the flexible resilient sheeting material is of a plastic material.

7. The game according to claim 5 wherein the length of the flexible resilient sheeting material is at least 25 percent longer than the width.

8. A missile propelling device for use according to claim 1 comprising a semi-rigid, substantially flat support having a length several times its thickness and capable of being flexed out of its plane by substantially longitudinally applied compressive force, and contact engaging material on at least a portion of at least one side of said support.

9. The device of claim 8 wherein handle means is provided on each end of said support and comprises a wall segment defining an aperture in the end of said support.

10. The device of claim 9 wherein an outer portion of said handle means is enlarged for hand-gripping.

* * * * *